United States Patent [19]

Kraus et al.

[11] 4,040,408

[45] Aug. 9, 1977

[54] SYSTEM FOR REDUCING TOXIC COMPONENTS IN THE EXHAUST GAS OF AN INTERNAL COMBUSTION ENGINE

[75] Inventors: Bernd Kraus, Stuttgart; Otto Glockler, Renningen, both of Germany

[73] Assignee: Robert Bosch GmbH, Stuttgart, Germany

[21] Appl. No.: 601,991

[22] Filed: Aug. 5, 1975

[30] Foreign Application Priority Data

Aug. 6, 1974 Germany ..... 2437713

[51] Int. Cl.[2] ..... F02B 3/00; F02M 39/00

[52] U.S. Cl. ..... 123/179 L; 123/32 EE; 60/276

[58] Field of Search ..... 123/32 EA, 119 EC, 179 L, 123/32 EE

[56] References Cited

U.S. PATENT DOCUMENTS

| | | | |
|---|---|---|---|
| 3,745,768 | 7/1973 | Zechnall | 123/32 EA |
| 3,828,749 | 8/1974 | Knapp | 123/32 EA |
| 3,938,479 | 2/1976 | Oberstadt | 123/32 EA |
| 3,949,551 | 4/1976 | Eichler | 123/32 EA |

*Primary Examiner*—Carroll B. Dority, Jr.
*Assistant Examiner*—Ronald B. Cox
*Attorney, Agent, or Firm*—Edwin E. Greigg

[57] ABSTRACT

A fuel supply and metering valve assembly used for fuel injection to an internal combustion engine includes a control pressure circuit which determines the restoring force on the movable valve member of the metering valve. The magnitude of the control pressure, and hence the fuel quantity metered out by the valve assembly, can be altered by intermittent actuation of a pressure relief valve whose duty cycle is controlled by an oxygen sensor located in the exhaust line of the engine. The oxygen sensor voltage is superimposed on a sawtooth voltage at the input of a control circuit which varies the duty cycle of the bypass valve. When the oxygen sensor is too cold to generate an output signal, the control circuit is provided with a temporary control signal supplied by a timing circuit until the oxygen sensor has reached its normal temperature and generates an output signal.

8 Claims, 4 Drawing Figures

SYSTEM FOR REDUCING TOXIC COMPONENTS IN THE EXHAUST GAS OF AN INTERNAL COMBUSTION ENGINE

BACKGROUND OF THE INVENTION

The present invention relates to an apparatus for reducing the toxic components in the exhaust gas of internal combustion engines by influencing the mass ratio of the fuel-air mixture supplied to the internal combustion engine, effected by varying the keying ratio (duty cycle) of a cyclically actuated electromagnetic valve disposed in the control pressure circuit of an engine fuel supply system. The electromagnetic valve is controlled by a regulating device in response to data from measuring transducers which monitor various operating parameters of the internal combustion engine, in particular by an oxygen sensor located in the exhaust system.

In this known system, a sawtooth generator produces a sawtooth voltage of constant frequency and amplitude which is used to vary the keying ratio of the electromagnetic valve. The sawtooth voltage is superimposed on a constant voltage, characteristic of engine operating parameters, and is applied to the inverting input of a summing amplifier of the regulating device. A predetermined voltage, derived from a voltage divider, is applied to the non-inverting input of the summing amplifier.

An apparatus of this type is intended to automatically provide a favorable fuel-air mixture for all operating conditions of the internal combustion engine so as to burn the fuel as completely as possible and thus to prevent toxic gases from being produced, or, at least, to considerably reduce the amount of toxic gases while obtaining maximum performance of the internal combustion engine or minimum fuel consumption, as desired. For this purpose, the quantity of fuel must be very accurately metered out in accordance with the requirements of each operating state of the internal combustion engine and the air-fuel ratio must be varied as a function of engine operating parameters such as speed, load, temperature and exhaust gas composition.

DESCRIPTION OF THE PRIOR ART

Known systems for reducing toxic components in the exhaust gas of internal combustion engines include an electromagnetic valve which is cycled intermittently by an electronic controller and which changes the pressure within a control pressure circuit in dependence on operational parameters of the internal combustion engine, thereby altering the fuel-air ratio. These known systems use an oxygen sensor in the exhaust line which delivers an output voltage that depends on the composition of the exhaust gas and this output signal is fed to an electronic regulator which controls the fuel air mixture so as to maintain the air number $\lambda$ at the valve $\lambda = 1$. When the oxygen sensor is at a temperature less than approximately 400° C, it is highly resistive and does not deliver a usable output voltage, so that, when starting a cold engine, an undesirable fuel-air mixture may be produced. It is known to install a warmup system which compensates for this disadvantage during the cold start of an internal combustion engine, but the compensating system is ineffective when the engine is started while still warm (approximately 40° C to 80° C). An internal combustion engine remains at or near its operating temperature for some time after it is shut off, whereas the oxygen sensor quickly cools below its own operational temperature due to its low heat capacity and because of the unfavorable ratio of surface to mass of structures within the exhaust system. As a consequence, during a renewed hot start of the engine and until such time as the oxygen sensor again reaches its operational temperature of approximately 400° C, the ratio of the fuel-air mixture does not correspond to the proper nominal value but sticks at one or the other control limit depending on the type of control system. This is most disadvantageous with respect to maintaining a low concentration of components in the exhaust gas and adversely affects the running characteristics of the internal combustion engine.

OBJECT AND SUMMARY OF THE INVENTION

It is a principal object of the invention to provide an apparatus to reduce the concentration of toxic components in the exhaust gas of internal combustion engines while maintaining a proper fuel-air mixture ratio during a hot start of the internal combustion engine.

It is a further object of the invention to provide a temporary control signal for regulating the fuel-air mixture while the oxygen sensor is inoperative.

These and other objects are attained, according to the invention, by providing a timer element, particularly a monostable multivibrator, which may be triggered at the start of the internal combustion engine. It is also provided that a supplementary DC voltage may be superimposed on the sawtooth voltage generated by a sawtooth generator.

All advantageous feature of the invention is that the timing period of the timing element may be adjusted so that it extends to the time when the oxygen sensor has reached its operational temperature. The timing element is connected to the output of a logic gate whose one input receives a starting pulse and whose other input receives the output pulse of a threshold switch embodied as an operational amplifier.

It is another advantageous feature of the invention to connect the non-inverting input of the amplifier to the tap of a voltage divider formed by a fixed resistor and a trimmer resistor and to connect the inverting input of the amplifier to the tap of a voltage divider formed by one fixed resistor and one temperature-dependent resistor, especially an NTC resistor which responds to the engine temperature. The output of the timer element is connected to the base of a transistor whose emitter is connected to the tap of a voltage divider consisting of two resistors, and whose collector carries a DC voltage which is to be superimposed on the sawtooth voltage. One resistor of the voltage divider is embodied as a temperature-dependent resistor responsive to engine temperature.

A further advantageous feature of the invention provides that the timer element is connected to the output of an AND gate whose one input receives a starting pulse and whose other input receives a pulse from a switch which is controlled by a temperature sensor in dependence on engine temperature.

Yet another advantageous feature of the invention provides that the output of the amplifier carries an output pulse only when the engine is at its operational temperature.

DESCRIPTION OF THE PREFERRED EMBODIMENTS

Figure 1:
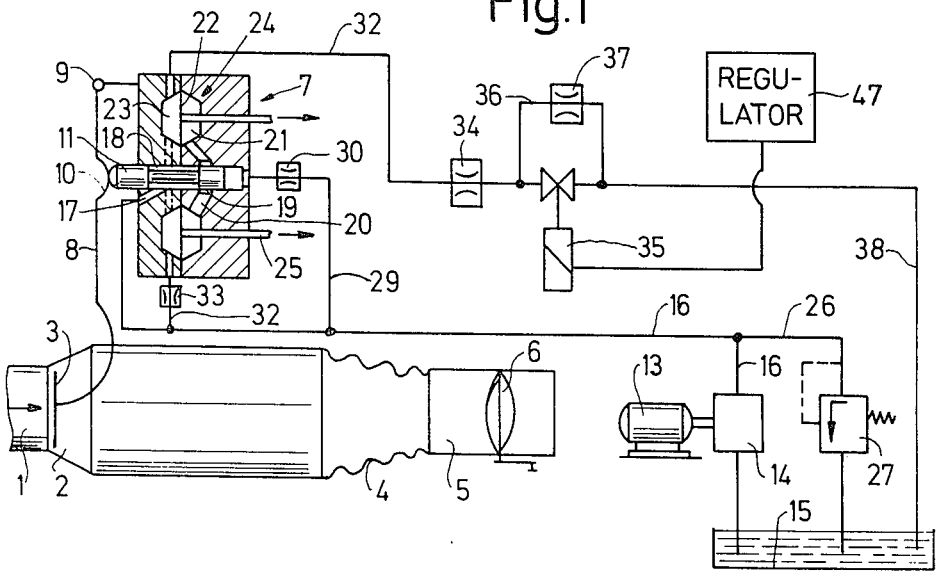
FIG. 1 is a partly schematic diagram of a first embodiment of an apparatus according to the invention for influencing the mass ratio of the fuel-air mixture supplied to an internal combustion engine.

Turning now to FIG. 1, it may be seen that the combustion air flows in the direction of the arrow through an induction tube 1 containing an air flow measuring sensor 3 within a conical region 2. The air then flows through a coupling hose 4 and an induction tube region 5, containing an arbitrarily actuatable butterfly throttle valve 6, to one or more cylinders (not shown) of the internal combustion engine. The sensor 3 is a plate disposed at right angles to the direction of air flow and it is deflected within the conical region 2 according to an approximately linear function of the air flow rate through the induction tube. If the restoring force exerted on the sensor 3, and the pressure prevailing upstream of the sensor 3 are both constant, then the pressure prevailing between the air sensor 3 and the butterfly valve 6 also remains constant.

The sensor 3 directly controls a fuel metering and distributing valve 7. A lever 8, connected to the sensor and mounted pivotably and in a largely frictionless manner, has a nose 10 which, during the pivoting movements of the lever, actuates the movable member of the fuel metering and distributing valve 7 which is embodied as a control slide 11.

Fuel is supplied by a fuel pump 14, driven by an electric motor 13, from a fuel tank 15 and is delivered through a fuel supply line 16 and a channel 17 to an annular groove 18 on the control slide 11. Depending on the position of the control slide 11, the annular groove 18 opens, to a greater or lesser extent, control slits 19, each of which leads through a channel 20 to a chamber 21. Each chamber 21 is separated from a chamber 23 by a diaphragm 22 which serves as the movable part of a flat-seat valve acting as a pressure-equalizing valve. From the chamber 21, the fuel is admitted through injection channels 25 to the individual fuel injection valves (not shown) which are located in the induction tube in the vicinity of the engine cylinders.

From the fuel supply line 16 extends a line 26 in which is disposed a pressure limiting valve 27. When there is excessive pressure in the system, the pressure limiting valve allows fuel to flow back into the fuel tank 15.

The face of the control slide 11 remote from lever 8 is exposed to the force of pressurized fluid which provides a restoring force for the sensor 3 and which exerts its force through a line 29 including a damping throttle 30.

Also extending from the line 16 is a line 32 including, in series, a decoupling throttle 33, the chambers 23 of the pressure-equalizing valves 24, a first throttle 34 and an electromagnetic valve 35. Connected in parallel to the electromagnetic valve 35 is a line 36 containing a second throttle 37 through which the fuel in the control pressure circuit 32 may return to the fuel tank without gauge pressure via the return flow line 38.

The apparatus shown in FIG. 1 operates as follows:

When the internal combustion engine is running, air is drawn in through the induction tube 1, 4 and 5 and, as a result, the sensor 3 is displaced from its rest position. In response to the deflection of the sensor 3, the control slide 11 of the fuel metering and distributing valve 7, which meters the quantity of fuel flowing to the injection valves, is displaced by the lever 8. The direct, positive coupling between the sensor 3 and the control slide 11 insures a constant ratio of the quantity of air to the metered-out quantity of fuel.

In order to adapt the fuel-air mixture to particular operating conditions of the internal combustion engine, it may be necessary to vary the pressure difference across the metering valve location 18, 19. The pressure difference across these metering valve locations can be advantageously regulated and varied in common by varying the pressure in the control pressure circuit 32. In the present embodiment, the differential pressure across the metering valve locations 18, 19 is varied by changing the differential pressure across the decoupling throttle 33 by varying the quantity of fluid flowing through it. This variation of the flow through the decoupling throttle 33 is made possible by the presence, in the control pressure circuit 32, of a first throttle 34 and an electromagnetic valve 35 with a second throttle 37 disposed in parallel thereto, all downstream of the decoupling throttle 33. When the electromagnetic valve 35 is closed, the quantity of fuel flowing through the decoupling throttle 33 is determined by the throttles 33, 34 and 37, whereas, when the electromagnetic valve is open, the quantity of fuel flowing in the control pressure circuit is determined by the throttles 33 and 34 alone, resulting in a reduced throttling action and an increased pressure drop across the decoupling throttle 33. As a result, the pressure difference at the metering valve locations 18, 19 is also increased. The pressure difference across the decoupling throttle 33 may be changed by varying the ratio of the duration of the open period to the closed period, i.e., by varying the keying ratio or duty factor of the electromagnetic valve 35. When the electromagnetic valve remains closed, the pressure difference is at a minimum and a lean fuel-air mixture is obtained, whereas, when the electromagnetic valve 35 remains open, the pressure difference is at a maximum and the fuel-air mixture is richest.

A storage element (not shown) could be provided in the control pressure circuit for any required damping of pressure fluctuations.

Figure 2:
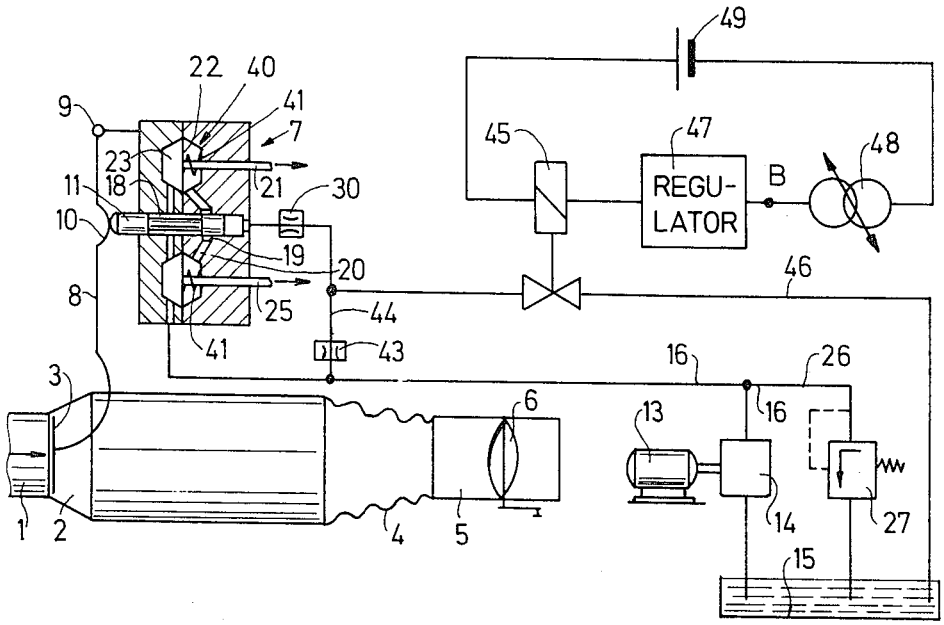
FIG. 2 is a similar diagram of a second embodiment for influencing the mass ratio of the fuel-air mixture supplied to the internal combustion engine.

In a second exemplary embodiment of the system, shown in FIG. 2, the electomagnetic valve 35 is actuated cyclically under the control, for example, of an oxygen probe disposed in the exhaust gas conduit of the internal combustion engine which acts through an electronic regulator device.

In FIG. 2, those parts of the apparatus which are the same as the parts shown in FIG. 1 retain the same reference numerals. The fuel delivered by the fuel pump 14 flows through the fuel supply conduit 16 into the chambers 23 of differential pressure valves 40 and to the annular groove 18 of the control slide 11. The fuel which is metered out at the control slits 19 flows through the channels 20 into the chambers 21 of the differential pressure valves 40, each of which contains a spring 41 which exerts a force urging the differential pressure valves in the opening direction. The differential pressure valves 40 maintain a constant pressure difference across the metering valve locations 18, 19 and this pressure difference is independent of the quantity of fuel flowing through the channels 25 to the injection valves. A decoupling throttle 43 decouples the fuel supply line 16 from the control pressure circuit 44. The control pressure fluid exerts a force on the face of the control slide 11 far from lever 8 and thus produces the restoring force for the sensor 3. The control pressure circuit 44 also includes an electromagnetic valve 45. When the electromagnetic valve 45 is open, it permits a return of the pressurized fluid through a return flow line 46 into the fuel tank 15. The electromagnetic valve 45 is controlled, via an electronic regulating device 47, by so-called oxygen sensor or probe 48, disposed in the exhaust gas line. The oxygen probe 48 is a part of an electric circuit which includes a voltage source 49.

Figure 3:
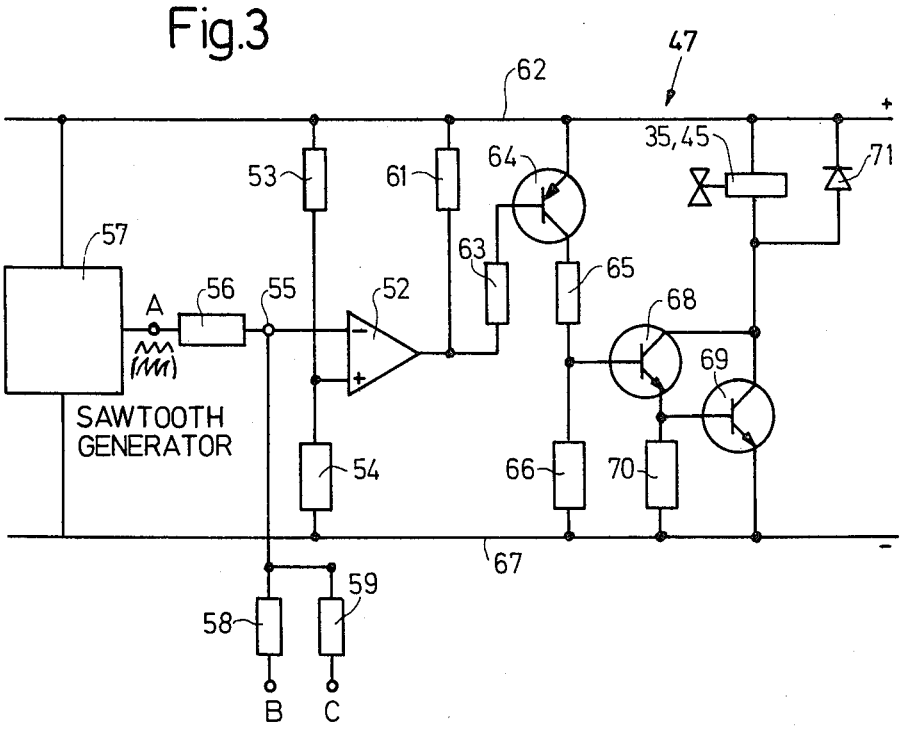
FIG. 3 is a circuit diagram of the electronic regulating device used in the apparatus according to FIGS. 1 and 2.

The circuit diagram of the electronic regulating device 47 is shown in FIG. 3. The device contains a summing amplifier 52 whose non-inverting input is connected to the tap of a voltage divider consisting of two resistors 53 and 54. The inverting input of the summing amplifier 52 is connected to a summing point 55 which is connected, through a resistor 56, to the output A of a sawtooth generator 57 and, through parallel resistors 58, 59, to various transducers which monitor the operating parameters of the internal combustion engine. Details of the sawtooth generator 57 are disclosed in U.S. Pat. No. 3,981,288. The output of the summing amplifier 52 is connected through a resistor 61 to a positive supply line 62, and through a resistor 63, to the base of a first transistor 64. The emitter of transistor 64 is connected to the positive line 62 and its collector is connected to a negative supply line 67 via a voltage divider circuit including two series resistors 65, 66. The base of a second transistor 68 is connected to the tap of the voltage divider circuit 65, 66. The emitter of the second transistor 68 is connected to the base of a third transistor 69 and to a resistor 70, connected to the line 67. The emitter of the third transistor 69 is also connected to the negative line 67 while its collector is connected to the collector of the second transistor 68 and also to the positive line 62 via the windings of the electromagnetic valve 35, 45. A diode 71 is connected in parallel with the windings of the electromagnetic valve 35, 45.

The method of operation of the electronic regulating device represented in FIG. 3 is as follows:

Assuming, by way of example, that the oxygen sensor places a voltage $U_e$ at the input B. If, for example, the voltage $U_e$ has the value O V, the voltage at the summing point 55 will be determined by the sawtooth voltage $U_f$, by $U_e$ and by the voltage dividers 56, 58. For low values of the sawtooth voltage $U_f$, the voltage at the summing point 55 will be below the reference voltage $U_m$ present at the non-inverting input of the summing amplifier 52 as determined by the voltage divider chain 53, 54. Therefore, the output voltage of the summing amplifier 52 is equal to the positive supply potential, the transistors 64, 68, 69 are blocked, and the electromagnetic valve 35, 45 is currentless. As the sawtooth voltage $U_f$ rises, the voltage at the summing point 55 eventually equals the value $U_m$. At this time, the amplifier output is switched over to the negative potential, possibly aided by a feedback resistor (not shown).

As a result, the transistors 64, 68, 69 are rendered conducting and the magnetic valve is opened by the current flowing through its windings. The sawtooth voltage $U_f$ decreases after passing through its maximum value and when it reaches the value $U_m$, the summing amplifier 52 switches back to the positive output potential, whereupon the transistors 64, 68, 69 block and the electromagnetic valve 35, 45 is currentless and closes.

If $U_e$ has a non-zero value, for example an arbitrary positive value, the switchover points occur at different times. Thus, the switchover during an ascending sawtooth segment will now occur earlier than was the case when $U_e$ was zero. Similarly, the switchover during a descending sawtooth segment will occur later than when $U_e$ was zero. As a result, the time between the two switchover points is prolonged and the opening duration of the valve is increased. Thus, it is possible to vary the pulse duration for controlling the electromagnetic valve in dependence on operating parameters characterized by the voltage $U_e$. The same discussion applies to any other voltages $U_e$, characterizing different operating parameters. The sawtooth generator may be of a type which supplies a sawtooth voltage comprising linear segments. In that case, there will be a linear relation between the voltage $U_e$ and the keying ratio of the electomagnetic valve. However, to eliminate the influence of disturbing voltage peaks which occur in the wiring system of motor vehicles, it may also be advantageous to employ a substantially less sensitive sawtooth generator which supplies a sawtooth voltage comprising segments corresponding to an exponential function, in particular to an *e*-function (*e* is the base of natural logarithms).

When employing a sawtooth voltage with segments corresponding to an *e*-function, it is advantageous if the utilized operating range lies between 20% and 80% of the maximum value, so that the deviation from linearity is negligibly small. The voltage generated by the oxygen sensor 48 can be fed to the electronic regulator 47 via the terminal B. Since the operating domain of the oxygen sensor begins only at temperatures of approximately 400° C, it is proposed, according to the invention, to deliver a time-dependent DC voltage to the electronic controller 47 via its terminal C during a hot start of the internal combustion engine. The provision of this DC voltage permits a definite value of the fuel-air mixture to be maintained until the oxygen sensor reaches its normal operational temperature.

Figure 4:
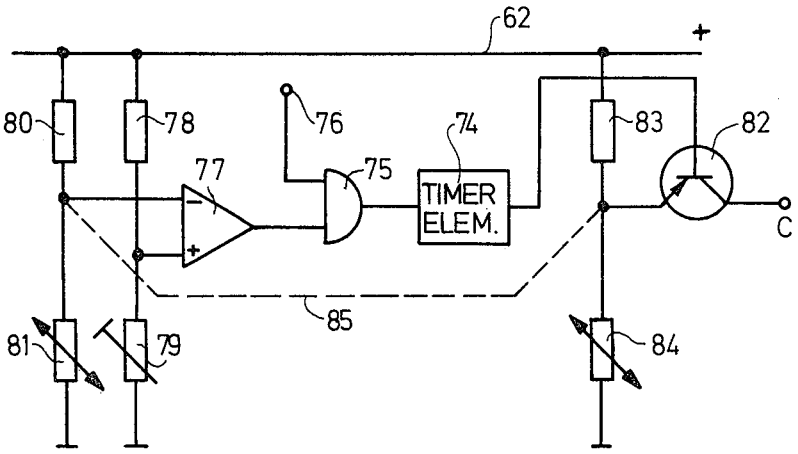
FIG. 4 is a schematic diagram of an electronic timing circuit for providing a control signal to the regulating device according to FIG. 3.

Advantageously, a timing circuit may be used such as is illustrated in FIG. 4, in which, immediately after the start of the internal combustion engine, a timer element 74, in particular a monostable multivibrator, is triggered. This circuit superimposes the supplementary DC voltage, through the connection C, on the sawtooth voltage generated by the sawtooth generator. The timing interval of the timing element 74 is so chosen that it extends over the time when the oxygen sensor has reached its normal operational temperature. The timer element 74 is connected to the output of an AND gate 75 whose one input receives a starting pulse through a contact 76 and whose other input may be supplied with the output pulse from a threshold-switch embodied as an amplifier 77. The non-inverting input of the amplifier 77 is connected to the tap of a voltage divider consisting of a fixed resistor 78 and a trimmer resistor 79 whereas the inverting input of the amplifier 77 is connected to the tap of a voltage divider consisting of a fixed resistor 80 and a temperature-dependent resistor 81. Preferably, the temperature-dependent resistor 81 is an NTC resistor. The output of the timer element 74 is connected to the base of a transistor 82 whose emitter is connected to the tap of a voltage divider consisting of two resistors 83, 84 and whose collector carries the additional DC voltage which is to be superimposed on the sawtooth voltage. Advantageously, the resistor 84 is embodied as a temperature-dependent resistor which responds to the engine temperature. This has the advantage that the magnitude of the additional DC voltage increases with increasing engine temperature, i.e. the fuel-air mixture becomes richer as a function of the engine temperature. Under certain circumstances, it may be suitable to connect the emitter of transistor 82 directly to the tap of the voltage divider 80, 81, bypassing the voltage divider 83, 84, as shown by the broken line 85.

The circuit illustrated in FIG. 4 operates in the following manner:

The voltage divider 78, 79 delivers a threshold voltage to the non-inverting input of the amplifier 77. The trimmer resistor 79 permits adjusting this voltage so that its value is exceeded by the voltage present at the inverting input of the amplifier 77 only when the engine is at its normal operational temperature, monitored by the temperature-dependent resistor 81 which is located near the engine. In that case, a signal is present at the output of the amplifier 77. The output signal of the amplifier 77 is fed to a first input of the AND gate 75 which triggers the timing element 74 when a starting pulse is also present at its second input 76.

The threshold switch could be replaced by a mechanical switch, for example by a temperature sensor (not shown), which controls a switch in dependence on the engine temperature. The switch could also be a bimetallic switch.

Under certain operational conditions, the temperature dependence of the system may be eliminated so that the timer element is triggered at each and every start of the engine. In that case, the timing interval of the timer element is so chosen that the oxygen sensor will always have reached its operational temperature when the timing interval has expired.

What is claimed is:

1. In an apparatus for reducing the concentration of toxic components in the exhaust gas of an internal combustion engine, which engine includes a fuel supply system, a fuel metering system, and a control pressure circuit for controlling said fuel metering system, said control pressure circuit including an electromagnetic valve, said apparatus including a regulating device for cyclic actuation of said electromagnetic valve, and an oxygen sensor located in the exhaust system of the engine and electrically connected to said regulating device, the improvement comprising:

a timing circuit, connected to said regulating device, for supplying a time-dependent control signal to said regulator device, said timing circuit including:

i. a threshold switch for receiving input signals and for generating an output signal;

ii. a logic gate, one of whose inputs is connected to the output of said threshold switch; and iii. a timer element, whose trigger input is connected to the output of said logic gate.

2. An apparatus as defined in claim 1, wherein said regulating device includes circuitry which produces a sawtooth voltage having linear segments.

3. An apparatus as defined in claim 1, wherein said regulating device includes circuitry which produces a sawtooth voltage having exponential segments.

4. An apparatus as defined in claim 3, wherein said regulating device including circuitry which produces a sawtooth voltage having exponential segments obeying an *e*-function ($U=ke^t$).

5. An apparatus as defined in claim 1, wherein said timing circuit further includes:

iv. first voltage divider means, connected across a source of potential and including, in series, at least one fixed resistor and one variable resistor;

v. second voltage divider means, connected across a source of potential and including, in series, at least one fixed resistor and one temperature-dependent resistor; and wherein said threshold switch is an operational amplifier whose non-inverting input is connected to the tap of said first voltage divider means and whose inverting input is connected to the tap of said second voltage divider means.

6. An apparatus as defined in claim 5, wherein said timing circuit further includes:

vi. third voltage divider means, connected across a source of potential and including at least two resistors in series; and vii. transistor means, the emitter of which is connected to the tap of said third voltage divider means and the base of which is connected to the output of said timer element.

7. An apparatus as defined in claim 6, wherein said third voltage divider means includes a temperature-dependent resistor so located as to be responsive to engine temperature.

8. In an apparatus for reducing the concentration of toxic components in the exhaust gas of an internal combustion engine, which engine includes a fuel supply system, a fuel metering system, and a control pressure circuit for controlling said fuel metering system, said control pressure circuit including an electromagnetic valve, said apparatus including a regulating device for cyclic actuation of said electromagnetic valve, and an oxygen sensor located in the exhaust system of the engine and electrically connected to said regulating device, the improvement comprising:

a timing circuit, connected to said regulating device, for supplying a time-dependent control signal to said regulator device, said timing circuit including:

i. temperature sensor means responsive to the engine temperature;

ii. switch means responsive to the output of said temperature sensor means;

iii. a logic gate, one of whose inputs is connected to the output of said switch means; and iv. a timer element whose trigger input is connected to the output of said logic gate.

* * * * *